United States Patent [19]

Hammarskog et al.

[11] Patent Number: 4,624,059

[45] Date of Patent: Nov. 25, 1986

[54] METHOD AND PLANT FOR COOLING PELLETS

[75] Inventors: Björn Hammarskog, Sala; Göran Mathisson; Sven Santén, both of Hofors, all of Sweden

[73] Assignee: SKF Steel Engineering AB, Hofors, Sweden

[21] Appl. No.: 666,198

[22] Filed: Oct. 29, 1984

[30] Foreign Application Priority Data

Aug. 24, 1984 [SE] Sweden ..... 8404220

[51] Int. Cl.[4] ..... F26B 3/16

[52] U.S. Cl. ..... 34/20; 34/31; 34/34; 34/54; 34/168; 34/169

[58] Field of Search ..... 34/20, 168, 34, 169, 34/54, 31; 432/77, 79, 97, 102, 99

[56] References Cited

U.S. PATENT DOCUMENTS

| | | | |
|---|---|---|---|
| 1,408,457 | 3/1922 | Harrison | 34/169 |
| 3,241,248 | 3/1966 | Gerlach et al. | 34/168 |
| 3,837,792 | 9/1974 | Deussner | 432/77 |
| 4,106,998 | 8/1978 | Okada et al. | 34/169 |
| 4,144,654 | 3/1979 | Barr | 34/168 |
| 4,268,359 | 5/1981 | Rammler et al. | 34/20 |
| 4,453,703 | 6/1984 | Ivanov et al. | 34/20 |

*Primary Examiner*—Larry I. Schwartz

*Attorney, Agent, or Firm*—Armstrong, Nikaido, Marmelstein & Kubovcik

[57] ABSTRACT

The invention relates to a method and means for cooling lump material in which the material in a vertical, gas-tight cooler (1) is subjected in a furst step to a transverse cooling flow (at 9) and in a second step to counter-flow cooling (at 20). Optimal cooling effect is obtained by a distribution of the cooling gas between transverse and counter-flow cooling in such a way that maximum temperature is obtained in the cooling gas leaving through the outlet (13).

7 Claims, 1 Drawing Figure

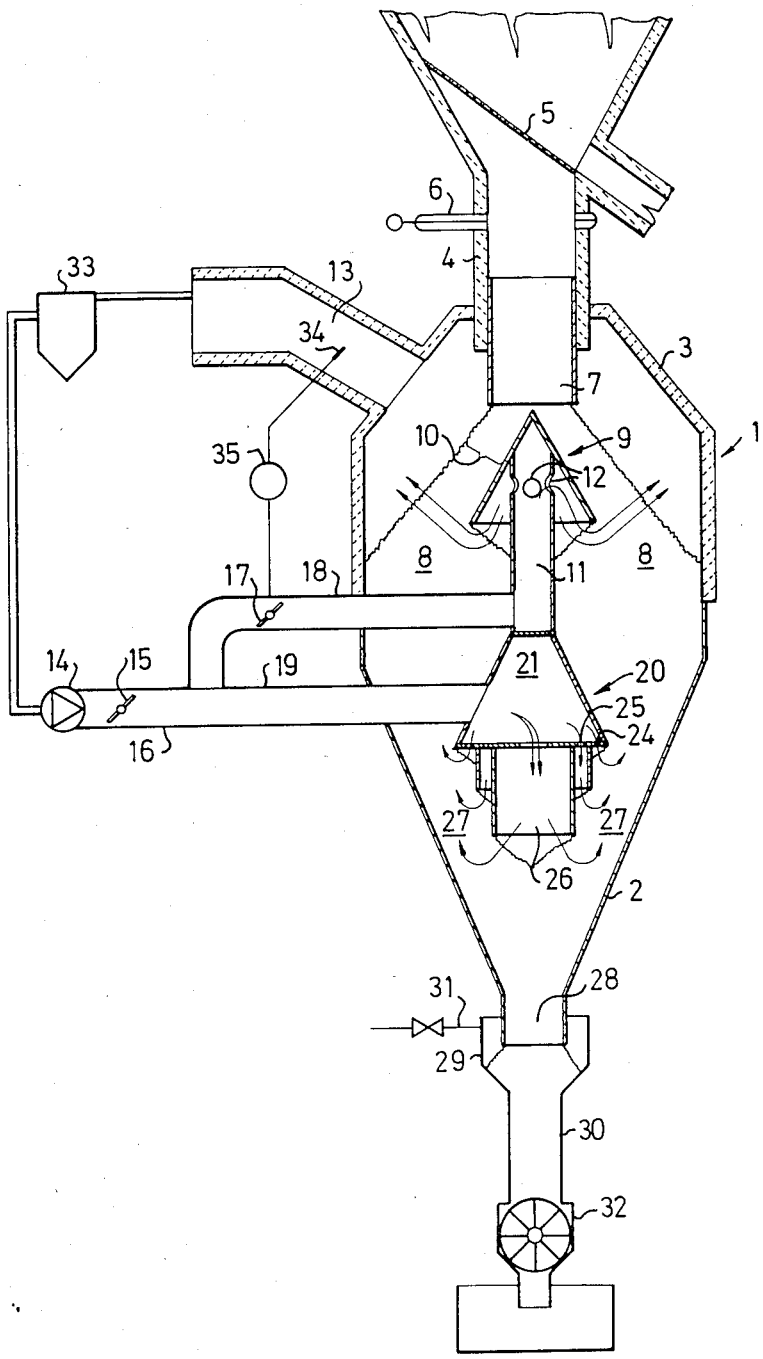
5
6
4
33
13
34
3
7
1
10
9
12
35
8
8
11
17
18
14
15
19
21
20
25
24
16
27
27
26
2
31
28
29
30
32

METHOD AND PLANT FOR COOLING PELLETS

The present invention relates to a method and means for cooling lump material such as sponge-iron, pelletized sinter, etc. from a temperature of 700°–1000° C., for instance, to a temperature below 100° C., in which the lump material from a previous process unit is supplied to the top of a vertical cooler through a supply pipe, provided with a valve, and is brought into contact with cold cooling gas, after which the cooled material is withdrawn through a feedout means arranged centrally in the bottom of the cooler.

In conventional coolers for cooling pelletized sinter and sponge-iron, for instance, either transverse or counter-flow cooling is used. However, these coolers do not function satisfactorily, particularly with respect to the temperature of the material leaving the cooler, this temperature varying within wide limits. In order to comply with the requirement for a maximal temperature for the gas leaving, therefore, a considerable excess of cooling gas is necessary. Despite this, the material may be discharged at a temperature exceeding the desired maximum temperature, particularly when counter-flow cooling is used. This is most unsatisfactory, especially in the case of sponge-iron cooling where the particles are ignited and re-oxidized upon contact with air or moisture at temperatures above ca. 100° C. This is primarily because the viscosity of the cooling gas increases with the temperature thus causing irregular distribution of the flow of cooling gas.

The object of the present invention is to effect a method enabling material substantially in particle form to be cooled to a uniform leaving temperature, in which each particle has a temperature below a stipulated maximum temperature and at the same time the cooling effect of the gas can be optimized.

Another object of the invention is to provide a cooler for carrying out the method according to the invention.

It has now been found that by utilizing the method according to the invention, a uniform temperature can be achieved in the cooled material, as well as a guarantee that no individual particle will have a temperature exceeding a predetermined maximum temperature, said method being characterised in that cooling gas is supplied centrally in the vertical cooler mentioned in the preamble, a first cooling gas flow being supplied in the upper part of the cooler and being caused to flow transversely to the flow-direction of the material entering, and a second cooling gas flow being supplied at the lower part of the cooler and being caused to flow in counter-flow to the material flowing through the cooler due to the force of gravity, the magnitude of the first and the second cooling gas flows being regulated in inverse proportion to each other to achieve optimum cooling effect.

The cooling gas is withdrawn through an upper outlet. The temperature of the cooling gas is recorded preferably by means of thermo-elements or the equivalent. In this case the ratio between the first and second flows of cooling gas is regulated, depending on the temperature in said cooling gas outlet, by means of a self-optimizing control system which influences one or more control valves located in the inlet pipes for the cooling gas.

According to one embodiment of the invention, the hot cooling gas, which leaves the system containing dust particles, is cleaned and compressed for recycling.

According to another embodiment of the invention, the lump material is caused to move through the cooler due to the force of gravity at a speed determined by a feedout means in the bottom of the cooler. The total flow of cooling gas is then regulated in relation to the production rate determined by the feedout means from the cooler.

When sponge-iron is being cooled, a gas comprising mainly $N_2$ and/or $CO_2$, optionally with the addition of CO and $H_2$, is preferably used as cooling gas. Air may be used as cooling gas for cooling pelletized sinter.

The particle size of the lump material is preferably within a range of 4–25 mm, but the material normally contains a fine-mesh proportion of up to ca. 10–15%, this fine-mesh proportion having a particle size less than ca. 4 mm. Particles exceeding ca. 25 mm in size are separated off on a grid or the like, before the inlet to the cooler.

The plant for cooling lump material comprises a vertical, insulated, gas-tight, cylindrical container having a conical bottom and a supply pipe, possibly provided with a valve, in which container the material moves under the influence of gravity. A feedout means arranged in the bottom of the cooling determines the flow rate of the material. The cooling plant further comprises a conical guide surface arranged centrally in the container, the point of the cone being located centrally below the supply pipe and at a predetermined distance therefrom, a supply pipe for a first cooling gas flow to below said guide surface, gas flowing from this pipe transversely to the hot lump material falling through the container, a supply pipe for a second cooling gas supply means located centrally in the lower conical part of the container, from which the cooling gas flows out in counter-flow to the lump material passing through the container, and also an upper outlet for the gas leaving the system.

According to a preferred embodiment of the invention the top angle of the conical guide surface is adjusted to agree with the angle of fall for the material entering. The guide surface will then distribute the lump material entering uniformly around the cylindrical cooler. Regulating the distance between the mouth of the supply pipe and the tip of the guide surface, enables the thickness of the layer of material flowing past the conical guide surface in the transverse flow area of the cooler to be regulated.

The supply pipe is preferably arranged always to be at least partially filled with material, and by adjusting its length and diameter, the column of material in the supply pipe can be caused to obstruct the flow of cooling gas to the parts of the equipment located above.

The gas-distribution means in the lower conical part of the container, i.e. in the counter-flow area of the cooler, is provided with at least one downwardly directed gas-supply means, from which the gas flows upwardly in counter-flow to the lump material falling through the annular gap formed between the lower conical wall of the container, and the gas distributing means. If necessary the gas distributing means is provided with several annular gas-supply gaps with decreasing diameter. The distribution of the gas flow through said annular gaps is regulated by means of throttling discs in the orifices.

An outlet means is arranged in the lower part of the cooler, determining the feed rate through the cooler. A pocket is preferably arranged at the mouth of the cooler, in which a supply means for a sealing gas may be arranged. This effects pressure equalisation and prevents the cooling gas from flowing downwardly instead of upwardly in counter-flow to the material. The feed-out pipe from the container may be in the form of a sealing pipe, the pressure drop over a column of material in the pipe thus limiting the gas release.

The feed-out means may preferably consists of a rotor valve which is capable of supporting a column of material in the event of a standstill.

Further advantages and features of the invention will be revealed in the following detailed description with reference to the accompanying drawing, in which the figure shows a schematical cross-section through a preferred embodiment of a cooler according to the present invention.

The drawing thus shows a cooler for performing the process according to the invention, in the form of a vertical, cylindrical container 1 having a conically tapering bottom 2. The container 1 is at least partially provided with a refractory lining 3 and is gas-tight.

The cooler is primarily designed for lump material with particles sizes of ca. 4–25 mm and with a fine-mesh proportion of ca. 10–15%, i.e. with particle sizes less than ca. 4 mm.

Lump material is fed into the container 1 through a supply pipe 4, whereupon particles larger than ca. 25 mm are separated onto a grid or the like, as indicated at 5, before the inlet to the cooler. The supply pipe may also be provided with a gas-tight closing valve 6. The mouth 7 of the supply pipe is preferably vertically adjustable, as will be further described below.

The material 8 flowing into the container encounters a conical guide surface 9, the top angle of which substantially agrees with the angle of descent of the material. The cone consists of sheet-metal arranged centrally in the container and is aligned with the symmetry axis of the supply pipe. The material is thus distributed uniformly around the cylindrical container. Adjustment of the distance between the mouth of the supply pipe and the cone, as well as adjustment of the diameter of the supply pipe according to the lump material, allows the supply pipe to be kept at least partially filled with material, thus acting as a gas lock. Furthermore, the distance will directly affect the thickness of the layer of material 10 flowing past the conical guide surface.

Below the conical guide surface 9 is a gas supply pipe 11 with apertures 12. The gas is distributed from the space formed below the conical guide surface and above the material which has already descended, and flows transversely through the material layer 10 to a cooling gas outlet 13.

Cooling gas is supplied to the cooler from a common main pipe 16 provided with fan 14 and adjustment means 15. This main pipe splits into a first supply pipe 18 provided with control valve 17, through which cooling gas is supplied to below the conical guide surface 9, and a second supply pipe 19 to supply cooling gas to a gas distributor 20 located in the conically tapering counter-flow part 2 of the cooler.

In the embodiment shown, the gas distributor 20 consists of an upper distribution chamber 21 becoming wide towards the bottom. Concentric rings 22, 23 are arranged below this, to provide one or more annular gaps 24, 25 for the supply of gas, as well as a central gas supply pipe 26, from which cooling gas is caused to flow up in counter-flow to the material falling through the annular space 27 formed between gas supply means 20 and the wall 2 of the container. Distribution of the gas flow through the annular gaps 24, 25 and the central pipe 26 is regulated by means of throttling discs or the like. The cooling gas is then withdrawn together with cooling gas from the transverse-flow section, through the common gas outlet 13.

The cooled material leaves the cooler through a central, bottom outlet 28, from which the material passes a pocket 29 and a feed-out pipe 30. The length and diameter of the feed-out pipe is adjusted so that a column of material will obstruct outflow of the cooling gas. The pocket 29 is used for cooling sponge-iron, in which case a supply means 31 is provided for the sealing gas in the form of $H_2$ and/or $CO_2$.

When air is used as cooling gas to cool pelletized sinter, no pocket or sealing gas is used.

A feed-out means 32, determining the rate at which the material is fed through the cooler, is arranged in the lower end of the feedout pipe. This feed-out means may be, for instance, of the rotor valve type which can support a column of material in the pipe in the event of a stop in production.

The hot cooling gas containing dust particles may be cleaned in a scrubber 33 and is then at least partially compressed and recycled to the cooler.

The total flow of cooling gas is determined by the total production, which in turn is controlled by the feed-out means 32. The flow distribution of cooling gas between the transverse and counter-flow zones in the cooler may, according to the preferred embodiment, be effected by means of a self-regulating optimizing system. The best cooling effect is obtained with a maximum temperature of the cooling gas leaving the container and by sensing the temperature of the gas leaving with the aid of thermo-elements 34 or the equivalent, the total flow of cooling gas can be optimized between transverse and counter-flow cooling by means of the regulating valve 17 in the first supply pipe 18 for cooling gas and the process unit indicated at 35.

A cooling gas consisting primarily of $N_2$ and/or $CO_2$, optionally with the addition of CO and $H_2$, is preferably used for cooling sponge-iron. Air may be used to cool pelletized sinter.

We claim:

1. A continuous method for cooling particulate material from a temperature of 700°–1000° C. to below 100° C. in a vertical cooling container comprising (a) forming the particualte material flowing from a processing unit into a cone-shaped layer of substantially uniform thickness;

(b) passing a first portion of non-oxidizing cooling gas transversely through said layer from the interior to the exterior of said cone;

(c) as the particulate material flows downwardly through said container, passing a second portion of non-oxidizing cooling gas upwardly through the material countercurrent to the direction of material flow;

(d) removing the non-oxidizing gas from said container at a point above said cone-shaped layer;

(e) discharging said cooled particulate material from the lower end of said container; and (f) regulating the gas flows of said first and second portions in inverse proportion to each other responsive to the temperature of the gas leaving the container so that maximum temperature is obtained in the gas leaving the container; and (g) regulating the total of the gas flows of said first and second portions in proportion to the quantity of cooled particulate material being discharged from said container.

2. The method of claim 1 wherein the gas leaving the container is cleaned, compressed and recycled into the container.

3. The method of claim 1 in which the particulate material is moved through the container by force of gravity at a rate determined by the rate at which the cooled material is removed from the lower end of said container.

4. The method of claim 1 in which said non-oxidizing gas is mainly nitrogen, carbon dioxide or a mixture thereof.

5. The method of claim 1 in which the particle size of the particulate material is within a range of 4–25 mm., the proportion of material with a particle size less than 4 mm. being not more than about 10–15%.

6. The method of claim 1 wherein the particles exceeding about 25 mm. in size are separated off before the particulate material is introduced into the container.

7. Apparatus for cooling lump material comprising (a) a vertical, insulated, gas tight, cylindrical container having a conical bottom and a supply pipe at the top thereof;

(b) a feedout means in the bottom of said container for regulating the rate of flow of material through the container;

(c) a conical guide surface disposed centrally in the container having its point located on the center line of said supply pipe and spaced a predetermined distance from the end of said supply pipe;

(d) a first cooling gas supply conduit connecting to the underside of said guide surface; a flow regulating valve in said conduit;

(e) gas distributing means located centrally within the conical portion of said container, said gas distributing means having a plurality of downwardly directed concentric discharge tubes, and throttling discs in said tubes to regulate gas flow;

(f) a second cooling gas supply conduit connecting to said gas distributing means;

(g) a primary gas supply means connecting to said first and second gas supply conduits;

(h) a gas outlet at the top of said container; and (i) temperature-sensitive means in said gas outlet connecting to said flow regulating valve to adjust said flow regulating valve in response to temperature change in said gas outlet.

* * * * *